US009381558B2

(12) United States Patent
Danninger et al.

(10) Patent No.: US 9,381,558 B2
(45) Date of Patent: Jul. 5, 2016

(54) PRESS TABLE OR PRESS BEAM HAVING ADJUSTABLE BEAM ELEMENT

(71) Applicant: TRUMPF Maschinen Austria GmbH & Co. KG., Pasching (AT)

(72) Inventors: Egon Danninger, Leonding (AT); Bernhard Fischereder, Voecklabruck (AT); Kabir Secibovic, Gunskirchen (AT); Gregor Spachinger, Wilhering (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 135 days.

(21) Appl. No.: 14/377,523

(22) PCT Filed: Feb. 8, 2013

(86) PCT No.: PCT/AT2013/050032

§ 371 (c)(1),
(2) Date: Nov. 18, 2014

(87) PCT Pub. No.: WO2013/116888

PCT Pub. Date: Aug. 15, 2013

(65) Prior Publication Data

US 2015/0143866 A1 May 28, 2015

(30) Foreign Application Priority Data

Feb. 10, 2012 (AT) ..... A 175/2012

(51) Int. Cl.
*B21D 5/02* (2006.01)
*B30B 15/00* (2006.01)
(Continued)

(52) U.S. Cl.
CPC ..... *B21D 5/0272* (2013.01); *B30B 15/007* (2013.01); *B30B 15/044* (2013.01); *B30B 15/068* (2013.01)

(58) Field of Classification Search
CPC .. B21D 5/0272; B30B 15/007; B30B 15/068; B30B 15/044
USPC ..... 72/453.13
See application file for complete search history.

(56) References Cited

U.S. PATENT DOCUMENTS 3,682,465 A 8/1972 Hänni
3,829,074 A 8/1974 Hanni et al.
(Continued)

FOREIGN PATENT DOCUMENTS

AT 351 896 B 8/1979
AT 397 942 B 8/1994
(Continued)

OTHER PUBLICATIONS

International Search Report of PCT/AT2013/050032, mailed May 28, 2013.

*Primary Examiner* — David B Jones
(74) *Attorney, Agent, or Firm* — Collard & Roe, P.C.

(57) ABSTRACT

Press table (3) or press beam (4) for a press brake (1), comprising a beam element (17) having an elongate support surface (18) for attaching a bending tool (19) or tool adapter, a support beam element (24) having approximately the same length (39) as the beam element (17), connecting elements (26) with which connecting points (25) on the beam element (17) are connected, with respect to the length (39) thereof, in particular symmetrically to the support beam element (24), at least one actuator (30) which acts between mutually facing pressure surfaces (28, 29) on the beam element (17) and on the support beam element (24) and which can exert an adjusting force (32) that runs approximately in the pressing direction (31) of the press brake (1) and as a result the support surface (18) of the beam element (17) is actively adjustable between a planar profile and a convex profile. In this case, the actuator (30) comprises a hose arrangement (33) which is arranged between the mutually facing pressure surfaces (28, 29), rests against the latter and is fillable with hydraulic fluid (34), and which extends substantially in the longitudinal direction of the beam element (17).

19 Claims, 5 Drawing Sheets

(51) Int. Cl.
*B30B 15/06* (2006.01)
*B30B 15/04* (2006.01)

(56) References Cited

U.S. PATENT DOCUMENTS

| | | | | | |
|---|---|---|---|---|---|
| 4,016,742 | A | * | 4/1977 | Shiokawa | B30B 15/007 72/389.5 |
| 4,098,109 | A | | 7/1978 | Cailloux | |
| 4,106,323 | A | | 8/1978 | Haenni et al. | |
| 4,966,029 | A | | 10/1990 | Zbornik | |
| 5,097,694 | A | * | 3/1992 | Haennit | B21D 5/0209 72/389.5 |
| 5,408,858 | A | | 4/1995 | Fukuda | |
| 6,871,521 | B2 | | 3/2005 | Sperrer | |
| 8,387,524 | B2 | | 3/2013 | Karlsson et al. | |
| 8,833,131 | B2 | | 9/2014 | Reiter et al. | |

FOREIGN PATENT DOCUMENTS

| | | | |
|---|---|---|---|
| CN | 1447722 | A | 10/2003 |
| CN | 1894091 | A | 1/2007 |
| CN | 101668597 | A | 3/2010 |
| DE | 1 452 677 | A1 | 4/1969 |
| DE | 26 27 517 | A1 | 12/1976 |
| EP | 0 340 167 | A2 | 11/1989 |

* cited by examiner

PRESS TABLE OR PRESS BEAM HAVING ADJUSTABLE BEAM ELEMENT

CROSS REFERENCE TO RELATED APPLICATIONS

This application is the National Stage of PCT/AT2013/050032 filed on Feb. 8, 2013, which claims priority under 35 U.S.C. §119 of Austrian Application No. A 175/2012 filed on Feb. 10, 2012, the disclosure of which is incorporated by reference. The international application under PCT article 21(2) was not published in English.

The invention relates to a press table or press beam for a press brake.

A problem which arises when bending workpieces, especially those with long bend edges, is that the bend angle obtained along the bend edge after the bending operation is not constant because the forming forces cause a flexion at the press beam or press table supporting the bending tool, which cannot be entirely prevented even if opting for a very solid construction. As a result, the depth by which a bending punch moves down is shorter at the workpiece center than at the ends of the bend edge, making the forming angle likewise less pronounced.

A known way of preventing these workpiece faults is to impart to the workpiece support surface on an active press table or press beam a certain degree of outwardly convex curvature using appropriate devices during a bending operation, which corresponds to the flexion of the non-actively deformable press beam or press table. The support surfaces supporting the bending tools therefore extend approximately parallel with one another and the depth to which a bending punch moves down along the bend edge is constant, thereby also resulting in a uniform forming angle.

A press brake on which a convex curvature can be imparted to the press table or press beam, also referred to as cambering, by means of a pre-stressing device is known from AT 351896 B. The press table or press beam comprises two half-panels which can be biased towards one another by means of a pre-stressing device, as a result of which an outwardly convex curvature can be imparted to the tool support surface. Other possible embodiments disclosed for the pre-stressing device are wedge arrangements or hydraulic cylinders.

The disadvantage of this system is that the pre-stressing forces expended by such pre-stressing devices in order to impart the curvature are transmitted as concentrated loads at predefined positions and thereby result in a curvature contour which matches the flexion of the press beam to only a slight degree because the latter is highly dependent on the positioning of the workpiece and the length of the bend edge.

The objective of the invention is to propose a press brake whereby a curved contour can be imparted to the press table or press beam which enables a high bending accuracy with uniform forming angles to be obtained for many applications whilst nevertheless being based on a simple construction.

The objective is achieved by means of a press table or a press beam of the generic type having the features according to the invention.

Due to the fact that the actuator comprises a hose arrangement disposed between the mutually facing pressure surfaces resting against the latter and fillable with hydraulic fluid, which extends substantially in the longitudinal direction of the beam element, the curved contour of the beam element is caused by a uniform load and not by concentrated loads. Since the forming forces generated during the operation of bending the workpiece likewise constitute a uniform load and thus results in a bending line corresponding to the flexion of the deformed, non-actively adjustable press beam or press table, the curved contour caused by the hose arrangement on the actively adjustable press table or press beam represents a better approximation of the flexion than would be the case if using concentrated loads to pre-stress the beam element on the active press table or press beam. Furthermore, the hose arrangement is a simple component for generating the pre-stressing action and hydraulic units are provided on most press brakes for driving the press beam, which can also be used to supply the hose arrangement with pressurized fluid.

A high rigidity can be obtained for a press table or press beam of a slim construction if the beam element and the support beam element are of a plate-shaped designed, overlap with one another in at least certain portions and extend substantially parallel with the working plane or press plane. A high bending strength of the beam element prevents a situation in which, when working with workpieces with shorter bend edges which act more or less like concentrated loads, local deformation or flexion occurs in the beam element, as could otherwise occur due to the flexible hose arrangement under concentrated loads.

It is also of advantage if the beam element or the support beam element forms a U-shaped cross-section in at least certain portions with a base and adjoining arms and the beam element extends around the support beam element or the support beam element extends around the beam element at least partially on either side by means of the arms. The hose arrangement contained between the pressure surfaces is therefore disposed in the interior of the press table or press beam and is well protected against mechanical damage. This also results in a good mutual guiding action and lateral support for the beam element and support beam element.

To enable even beam elements with a very high bending strength to be pre-stressed, it is of advantage if the hose arrangement has a working length between the pressure surfaces which approximately corresponds to the distance between two connecting points on the beam element. This enables a uniform load to be applied to the entire bending length, thereby resulting in a high pre-stressing force.

Alternatively, the connecting points or bolts may be disposed, relative to the height of the beam element, in the half spaced at a distance apart from the support surface in the working direction, thereby resulting in a more homogeneous bending curve of the beam element.

If a pivot bearing is provided at the connecting points between the beam element and support beam element, a bending line of the beam element is obtained which is substantially brought about solely by the uniform load of the hose arrangement, which prevents disruptive inner tensions in the press table or press beam because slight mutual changes of angle are not impeded.

Similar advantageous effects can also be obtained if a slide bearing is provided at the connecting points because changes in length between the connecting points induced by the deformation of the beam element and support beam element are not impeded.

Increased ability for movement between the beam element and support beam element can also be achieved if at least one bending-resistant element extends respectively from the connecting points on the beam element to a fixing point on the support beam element.

If the arms of the U-shaped beam element are retained by means of at least one cross-connector at a fixed distance from one another after the hose arrangement as viewed from the support surface, the stability of the press table or press beam is increased, preventing deformation or cambering transversely to the pressing direction.

The hose arrangement may comprise at least two hose portions extending parallel with one another, which are hydraulically connected in parallel, so that the force transmitted to the pressure surface of the beam element is distributed over several contact lines or contact surfaces. The force transmission is therefore more uniform and load peaks on the hose arrangement as well as the beam element and support beam element are reduced.

Handling and assembly of the hose arrangement is made easier if adjacent parallel hose portions are connected to one another to form a hose assembly. The connection may be established by welding or adhesive along sleeve lines of the hose portions.

The hose arrangement may comprise two or more hose assemblies disposed one above the other in the pressing direction, thereby enabling the deformation height to be increased if one hose assembly is not sufficient to generate the required maximum camber. The hose assemblies may be separated by a stiff intermediate layer.

The pressure surfaces on the beam element and/or support beam element may have concave recesses for partially accommodating the hose arrangement, thereby reducing load peaks on the hose arrangement and preventing undefined deformation of the hose arrangement.

For bending operations in which it is not necessary to camber the press table or press beam, the beam element is placed in contact with the support beam element in the region of the pressure surfaces with the hose arrangement devoid of pressure. The bending strength and strength of the beam element is therefore supplemented by that of the support beam elements.

To impart greater flexibility to the hose arrangement and hence also greater deformability, the hose arrangement may comprise a hose portion with a strengthening material made from a synthetic fiber braid.

The pressurized fluid supply unit connected to the hose arrangement may have at least one substantially leakage-free valve, in particular a seat valve or cartridge valve to provide easy control of the filling volume and hence the pressure and camber height. An existing pre-tensioning can therefore easily be maintained because the pressure does not drop once the valve is closed.

To enable operation of the valve to be easily integrated in an existing control device of the press brake and obtain a rapid and sensitive adjustment of the filling volume and camber height, it is of advantage if the valve has an electromagnetic operating unit.

In particular, the valve may be actuated by a pulse-width modulator.

To provide a clearer understanding, the invention will be described in more detail below with reference to the appended drawings.

These are highly schematic, simplified diagrams illustrating the following:

Figure 1:
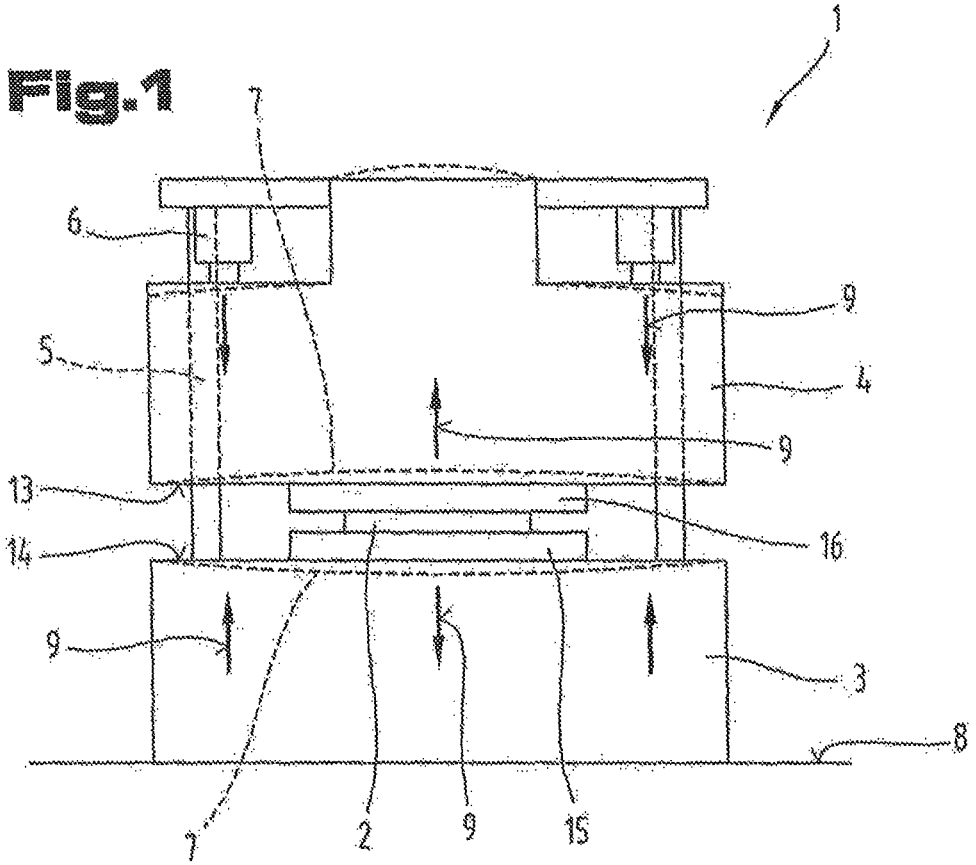
FIG. 1 is a view of a press brake showing the deformation which occurs during a pressing operation.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates the front view of a press brake 1, by means of which straight bending operations can be performed on a workpiece 2. To this end, the press brake 1 comprises two press beams which are adjustable relative to one another, which act on the workpiece 2 by means of bending tools in the form of a bending punch and a bending die. The bottom stationary press beam illustrated in FIG. 1 is therefore referred to as a press table 3 which, together with the bending die, serves as a support for the workpiece 2 and co-operates with the adjustable press beam 4 and the bending punch disposed on it. The press beam 4 is mounted so as to be displaceable on the stationary machine frame of the press brake 1 by means of a guide arrangement 5 and is driven by drive means 6, for example in the form of hydraulic cylinders.

As illustrated in FIG. 1, an elastic flexion 7 indicated by broken lines generally occurs on the press beam 4 during a bending operation because the working lines of the forces of the drive means 6 and the force exerted by the workpiece 2 on the press beam 4 do not coincide. Flexion 7 can also occur on the press table 3 because the working lines of the forces exerted by the workpiece 2 on the press table 3 and the forces exerted by the standing surface 8 on the press table 3 do not coincide.

Such flexion 7 of the press beam 4 or press table 3 causes a workpiece 2 to be pushed down into the bending die to a less pronounced depth at the center of the edge to be bent by the bending punch than at the ends of the bend edge, as a result of which a different bend angle can occur on the bent workpiece 2 along the bend edge, which means that such a workpiece could possibly need additional work or may be totally unusable. The forces 9 causing the respective flexion 7 on the press table 3 or press beam 4 are indicated in FIG. 1 on a simplified basis by arrows.

Figure 2:
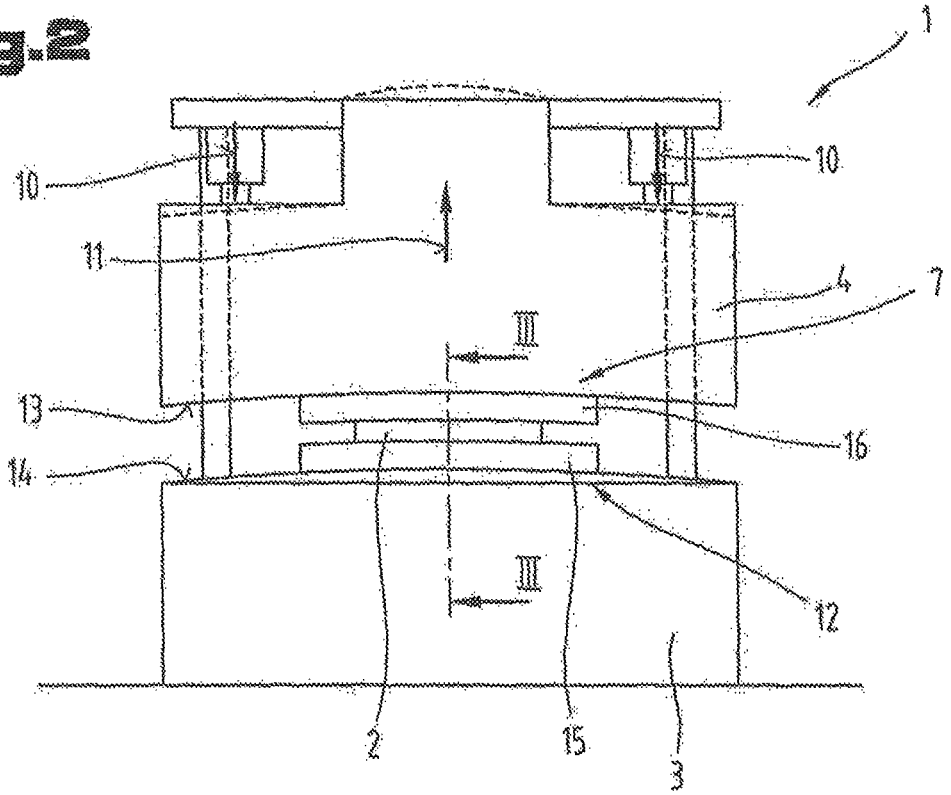
FIG. 2 is a view of a press brake based on FIG. 1, where the deformation of the press beam is compensated by an active deformation of the press table.

A way of preventing detrimental effects on a workpiece 2 due to flexion 7 of the press table 3 or press beam 4 is known from the prior art and involves taking active counter-measures on the press table 3. As illustrated in FIG. 2, a uniform penetration depth of a bending punch in a workpiece 2 can be achieved by actively imparting to the press beam 4 a camber 12 which approximately corresponds to the flexion 7 on the press beam 4 in order to compensate for flexion 7 on the press beam 4 induced by the driving forces 10 of the drive means 6 as well as the forming force 11 of the workpiece 2 simultaneously acting on the press table 3.

The concave bottom face 13 of the press beam 4 caused by flexion 7 co-operates with the convexly cambered top face 14 of the press table 3, thereby resulting in a uniform penetration depth of the bending punch into the workpiece 2 along the bend edge and hence also a much more constant bend angle along the bend edge.

Possible embodiments of a press table 3 proposed by the invention will be described below, and the structural characteristics and features described can literally be transposed to a displaceable press beam 4 and therefore apply not only to a press table 3 but also to a press beam 4, the support surface for a bending die 15 or a bending punch 16 which can actively be altered from a planar initial position to a convex, outwardly curved shape.

Figure 3:
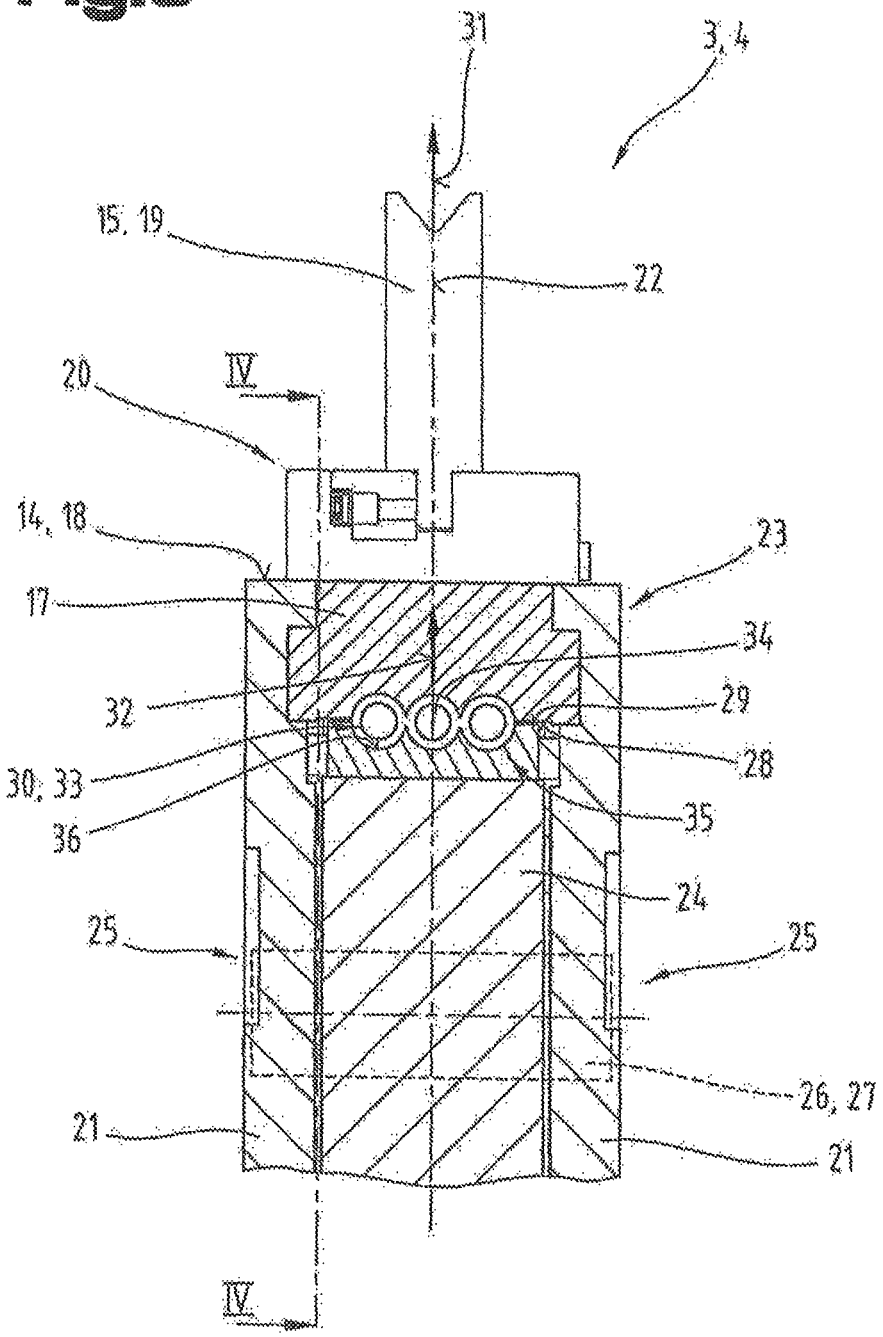
FIG. 3 is a partial section through a press table proposed by the invention along line III-III indicated in FIG. 2.

FIG. 3 illustrates a section along line III-III indicated in FIG. 2 through a press table 3 of a press brake 1. It comprises a beam element 17 having on its top face 14 an elongate support surface 18 extending in the direction of the width of the press brake 1. In the embodiment illustrated as an example, a bending tool 19, in this instance a bending die 15, is mounted on the support surface 18 by means of a clamping device 20. The beam element 17 is of a U-shaped design, the support surface 18 being formed by the base of the U and the arms 21 of the U-shaped beam element 17 extending downwards from the base, parallel with the working plane 22 of the press brake 1.

The base 23 of the U-shaped beam element 17 constituting the support surface 18 on its own would have a very low bending strength but because of the connection to the arms 21 parallel with the working plane 22, the beam element 17 overall has a relatively high bending strength, as is generally required of press brakes 1. The connection between the base 23 and the arms 21 may specifically comprise a positive connection parallel with the working plane 22, thereby resulting in a stable force transmission between the base 23 and arms 21. Another option is a one-piece, e.g. welded, connection between the base 23 and arms 21.

The beam element 17 is connected to a support beam element 24 of approximately the same length, which likewise has a plate-shaped main structure and extends approximately parallel with the working plane 22. In the embodiment illustrated as an example, the support beam element 24 is disposed in the interior of the U-shaped beam element 17 and is enclosed between the two arms 21. Connecting points 25 are provided on the beam element 17 at which it is connected by means of connecting elements 26, for example in the form of bolts 27, to the support beam element 24. The beam element 17 and the support beam element 24 therefore overlap in the region of the arms 21.

The bolts 27 extend at a right angle to the working plane 22 of the press brake 1 and extend through both the arms 21 of the beam element 17 and the support beam element 24. Such a design of press table 3 or press beam 4 with mutually overlapping portions of beam element 17 and support beam element 24 may also be described as a sandwich layout.

The beam element 17 has a pressure surface 28 facing the support beam element 24 and in the embodiment illustrated as an example lies on the inner face of the base 23. The support beam element 24 also has a pressure surface 29 which faces the pressure surface 28 on the beam element 17. To enable an active camber 12 to be imparted to the support surface 18 of the beam element 17 as illustrated in FIG. 2, an actuator 30 is provided between the pressure surface 28 on beam element 17 and the pressure surface 29 on support beam element 24, which is able to expend an adjusting force 32 extending approximately in the pressing direction 31, which is upwardly oriented in the case of a press table 3, to the bottom face of the beam element 17.

The actuator 30 is provided in the form of a hose arrangement 33 extending in the longitudinal direction of the beam element 17 which can be filled with hydraulic fluid 34. In the embodiment illustrated as an example, the hose arrangement 33 comprises three mutually parallel hose portions 35, which are supported on both the pressure surface 28 of the beam element 17 and the pressure surface 29 on the support beam element when filled with hydraulic fluid 34 and thus transmit the adjusting force 32 to the beam element 17.

The three mutually parallel hose portions 35 of the hose arrangement 33 illustrated in FIG. 3 are embedded in concave recesses 36 in the pressure surfaces 28 and 29 although it would also be possible for the pressure surfaces 28 and 29 to be of a flat design and for the hose arrangement 33 to comprise an individual, flatly pressed hose with a bigger cross-section, for example.

The press table 3 may be designed so that when the hose arrangement 33 is not filled or is without pressure, the beam element 17 is supported to the side of the hose arrangement 33 with support surface 28 on support surface 29 of the support beam element 24, so that when the press brake 1 is being operated without activating the cambering device, the bending strength of the beam element 17 is additionally enhanced by the bending strength of the support beam element 24.

The hose arrangement 33 comprises flexible hose portions, the strength of which is selected so that they can withstand the maximum pressures that will be generated by the hydraulic fluid 34 without bursting. In one advantageous embodiment, hoses incorporating a strengthening material made from a synthetic fiber braid are used because they have a higher elasticity than hoses with a metal braid and can therefore cover longer adjustment paths when creating the camber 12.

The hose arrangement 33 preferably has a working length between the pressure surfaces 28 and 29 which approximately corresponds to the distance between two connecting points 25 on the beam element 17. The total free bending length of the beam element 17 and a uniform load can therefore be applied by the hose arrangement 33, thereby creating a camber 12 which is approximately parallel with the flexion 7 of the press beam 4.

As illustrated in FIG. 3, mutually parallel hose portions 35 can be connected to form a hose assembly 37, for example by adhering or welding the individual hose portions 35 to one another along casing lines. To generate a uniform adjusting force 32, the individual hose portions 35 are hydraulically connected in parallel.

As illustrated in FIG. 3, the hose arrangement 33 may be positioned closer to the support surface 18 than the connecting points 25 on the beam element 17. The camber curve is less influenced by the spacing of the connecting points 25 than if the connecting points 25 were disposed closer to the support surface 18.

Figure 4:
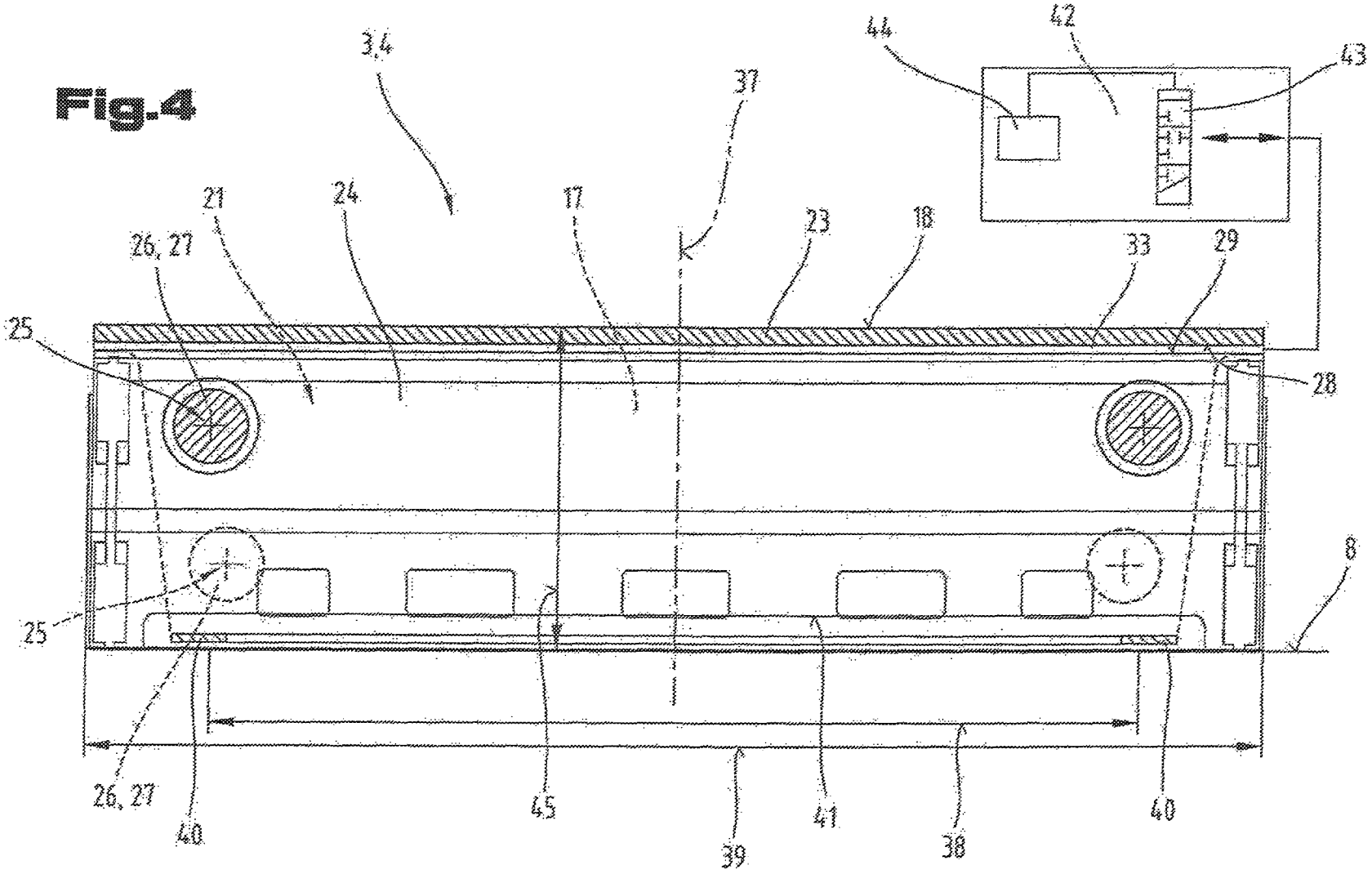
FIG. 4 is a section through one possible embodiment of a press table along line IV-IV indicated in FIG. 3.

FIG. 4 shows a section through a press table 3 along line IV-IV indicated in FIG. 3, the same components being denoted by the same reference numbers so that components that are the same or have the same effect will not be described again.

FIG. 4 shows the support beam element 24 supported on the standing surface 8 and the beam element 17, the base 23 of which constitutes the support surface 18 for the bending tool and the arms 21 of which overlap the support beam element 24 at both sides. As may be seen from FIG. 4, the connecting points 25 on the beam element 17 are disposed symmetrically with respect to the mid-plane 37 of the press table 3, but in particular the connecting points 25 preferably lie on the extended working lines of the drive means 6, thereby resulting in a bending length 38 between the connecting points 25 on the beam element 17 which preferably matches the corresponding bending length between the drive means 10 on the adjustable press beam 4. The beam element 17 and support beam element 24 are also of substantially the same length 39, which corresponds to the working width of the press brake 1.

In the embodiment illustrated in FIG. 4, the two arms 21, which may also be termed aprons, are additionally connected to the base 23 by means of cross-connectors 40 which prevent any cambering of the arms 21 transversely to the working plane 22. The cross-connectors 40 in this embodiment are disposed on the bottom end of the arms 21 and extend in a recess 41 in the bottom face of the support beam element 24. The hose arrangement 33 may correspond to the hose arrangement 33 described in connection with FIG. 3 and can be filled with hydraulic fluid 34 so that it applies a uniform load to the pressure surface 28 on the bottom face of the base 23 so that the support surface 18 is cambered between the connecting points 25, resulting in a camber 12 as illustrated in FIG. 2.

The extent of the camber can be fixed by the regulated intake of hydraulic fluid 34 and the associated regulated pressure increase in the hose arrangement 33. For example, during a bending operation, it is possible to calculate the flexion 7 of the press beam on the basis of workpiece parameters or detect it by means of an appropriate measuring system during the bending operation and on this basis, the camber 12 can be set to the same dimension by regulating the intake of hydraulic fluid 34. If calculating the anticipated flexion 7 of the press beam 4 beforehand, the camber 12 of the press table 3 can also be set prior to running the bending operation. If measuring flexion 7 during the bending operation, the camber 12 is likewise adjusted to the right fit during the bending operation. In addition, it is also possible to measure the camber 12, in other words the camber of the support surface 18, during the bending operation, and the camber 12 can then be regulated by a subsequent adjustment adapted to the measured or calculated flexion 7 of the press beam 4.

The hose arrangement 33 is supplied with hydraulic fluid 34 by means of a pressurized fluid supply unit 42 incorporating at least one substantially leakage-free valve 43, so that when the valve is closed, the fluid pressure can be easily kept constant during a bending operation. The valve 43 is a seat valve or cartridge valve, for example. The valve 43 is preferably operated by means of an electromagnetic operating unit, as a result of which the hose arrangement 33 can be supplied with hydraulic fluid 34 in a simple manner integrated in the control device of the press brake 1. The valve 43 may be activated in particular by means of a pulse-width modulator 44, which can be integrated in the pressurized fluid supply unit 42 or provided by the control device of the press brake 1.

The hose arrangement 33 may also be of a multi-layered design, for example by disposing two of the hose assemblies illustrated in FIG. 3 one above the other with an appropriate stiff intermediate plate in between. As an alternative to a hose assembly with several parallel hose portions 35, another option is to use a single hose with a bigger cross-section, which has an oval, pressed-flat shape in the initial position between the pressure surfaces 28 and 29 without pressure and which increases in height when filled with hydraulic fluid 34.

As illustrated in FIG. 4, the connecting points 25 are disposed in the top half adjacent to the support surface 18 relative to the height 45 of the beam element 17 but it would also be possible for the connecting points 25 to be disposed in the bottom half at a distance apart from the support surface 18 relative to the height 45 of the beam element, as indicated by broken lines.

Figure 5:
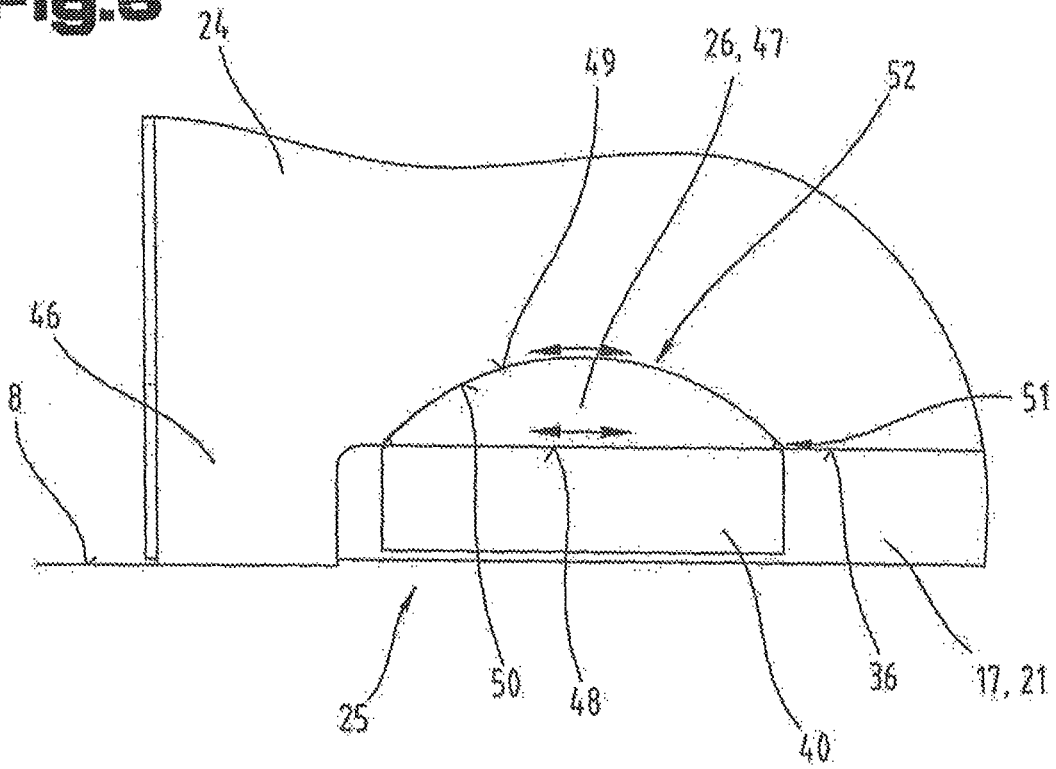
FIG. 5 illustrates another possible embodiment of the connection between the beam element and support beam element.

FIG. 5 illustrates an alternative embodiment of the connection between the beam element 17 and support beam element 24. The support beam element 24 sits in contact with the standing surface 8 by means of feet 46 and the U-shaped cross-section of the beam element 17 surrounds the support beam element 24 in the manner already described in connection with FIGS. 3 and 4.

In this embodiment, it is not bolts serving as the connecting elements 26 between the beam element 17 and support beam element 24 as described in connection with FIGS. 3 and 4 and instead, it is the cross-connectors 40 which connect the arms 21 of the beam element 17 to one another at the bottom edge, and the hose arrangement 33 moves into contact with the recess 41 on the bottom face of the support beam element 24 when activated by introducing hydraulic fluid. The cross-connector 40 may lie directly against the bottom face of the support beam element 24 but it is of advantage if a pressure segment 47 is disposed between the support beam element 24 and cross-connector 40 as illustrated in FIG. 5, which lies with its flat bottom face 48 on the flat top face of the cross-connector 40 and is inserted by an arcuately curved top face 49 in an arcuately curved bearing recess 50 in the support beam element. As a result, a slide bearing 51 is formed between the bottom face 48 of the pressure segment 47 and the top face of the cross-connector 40 which, when activated, facilitates the relative movements occurring between the beam element 17 and support beam element 24 due to deformation. By imparting the camber to the support surface 18 between the connecting points 25, the support surface 18 is made slightly longer, whereas the bottom face of the beam element 17 is made slightly shorter. Conversely, the support beam element is made longer due to the uniform load applied by the hose arrangement 33 to the bottom face, in other words in the region of the recess 41, and a slight shortening occurs in the region of the pressure surface 29, and the slide bearing 51 facilitates these changes in length and reduces internal tension in the press table 3 as a result. In addition, the top face 49 of the pressure segment 47 and the bearing recess 50 in the support beam element 24 form a pivot bearing 52 which also permits slight changes in angle due to the opposing deformations or bending lines of the beam element 17 and support beam element 24 induced by the hose arrangement 33.

Figure 6:
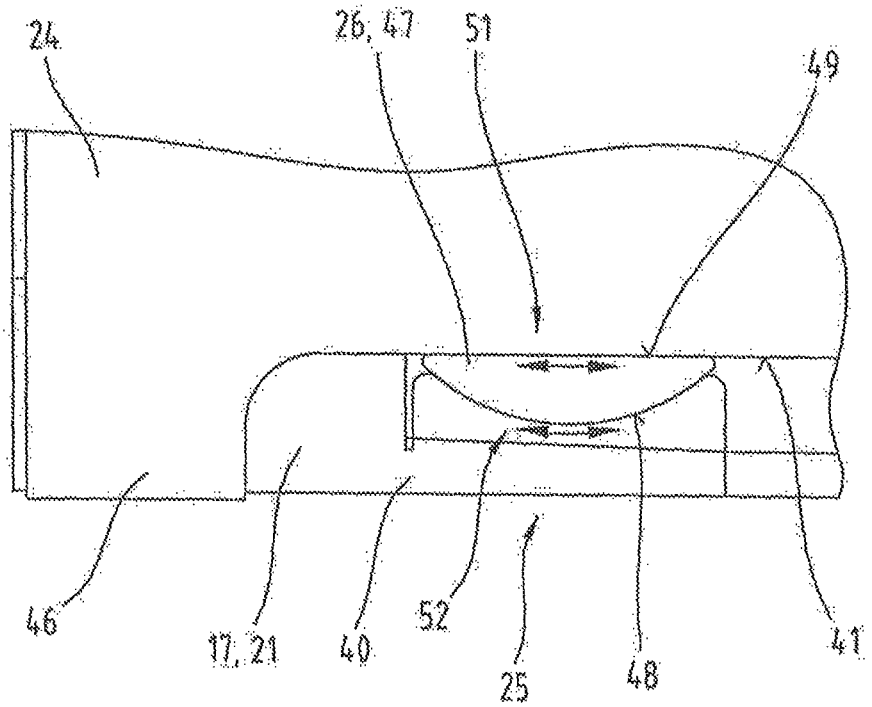
FIG. 6 illustrates another possible embodiment of the connection between the beam element and support beam element.

FIG. 6 illustrates another, optionally independent, embodiment, the same reference numbers and component names being used for the same parts as those used in connection with FIGS. 1 to 5 above. To avoid unnecessary repetition, reference may be made to the more detailed description of FIGS. 1 to 5 above.

Here too, the use of a pressure segment 47 between the beam element 17 and support beam element 24 results in a slide bearing 51 and a pivot bearing 52, which enables the beam element 17 and support beam element 24 to be bent by the hose arrangement 33 as well as by bending forces during the bending operation without creating a high degree of stress in the press table 24. In this embodiment, the bottom face of the pressure segment 47 is of an arcuately curved design and the top face 49 is a flat surface.

Figure 7:
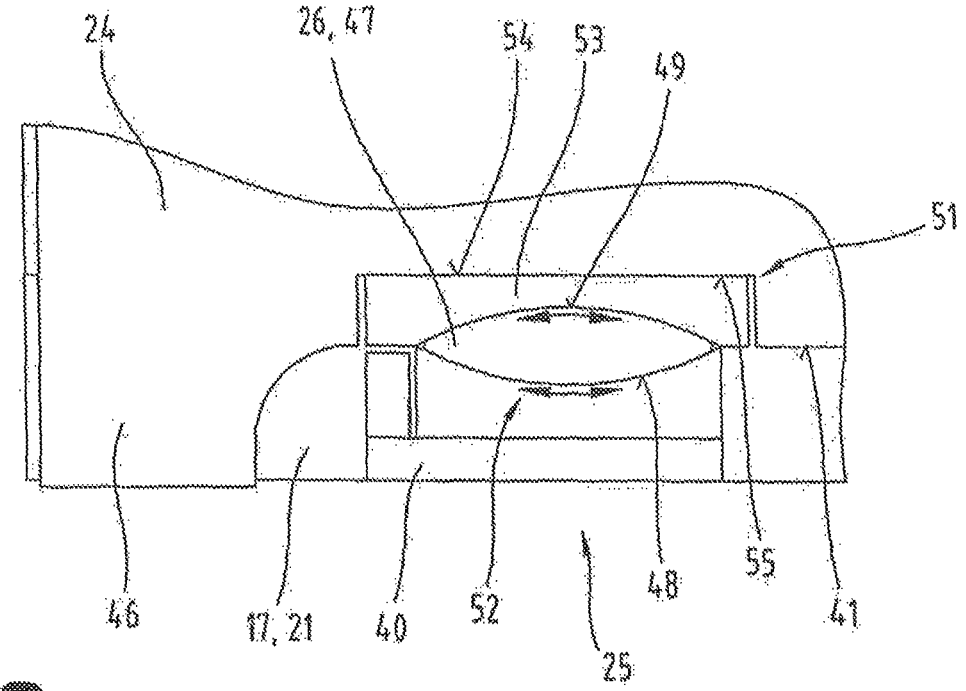
FIG. 7 illustrates another possible embodiment of the connection between the beam element and support beam element.

FIG. 7 illustrates another, optionally independent, embodiment, the same reference numbers and component names being used for the same parts as those used in connection with FIGS. 1 to 6 above. To avoid unnecessary repetition, reference may be made to the more detailed description of FIGS. 1 to 6 above.

In this embodiment, the pressure segment 47 has a curved shape on both the bottom face 48 and the top face 49 and thus has a lenticular cross-section. The bottom face 48 is inserted in a co-operating recess in the cross-connector 40 and the curved top face 49 is inserted in a sliding piece 53 which is mounted by the top face in a guide recess 55 with a flat slide surface 54 so as to be displaceable on the bottom face of the support beam element 24. Again in this embodiment, a slide bearing 51 and a pivot bearing 52 are formed at the connecting point 25.

Figure 8:
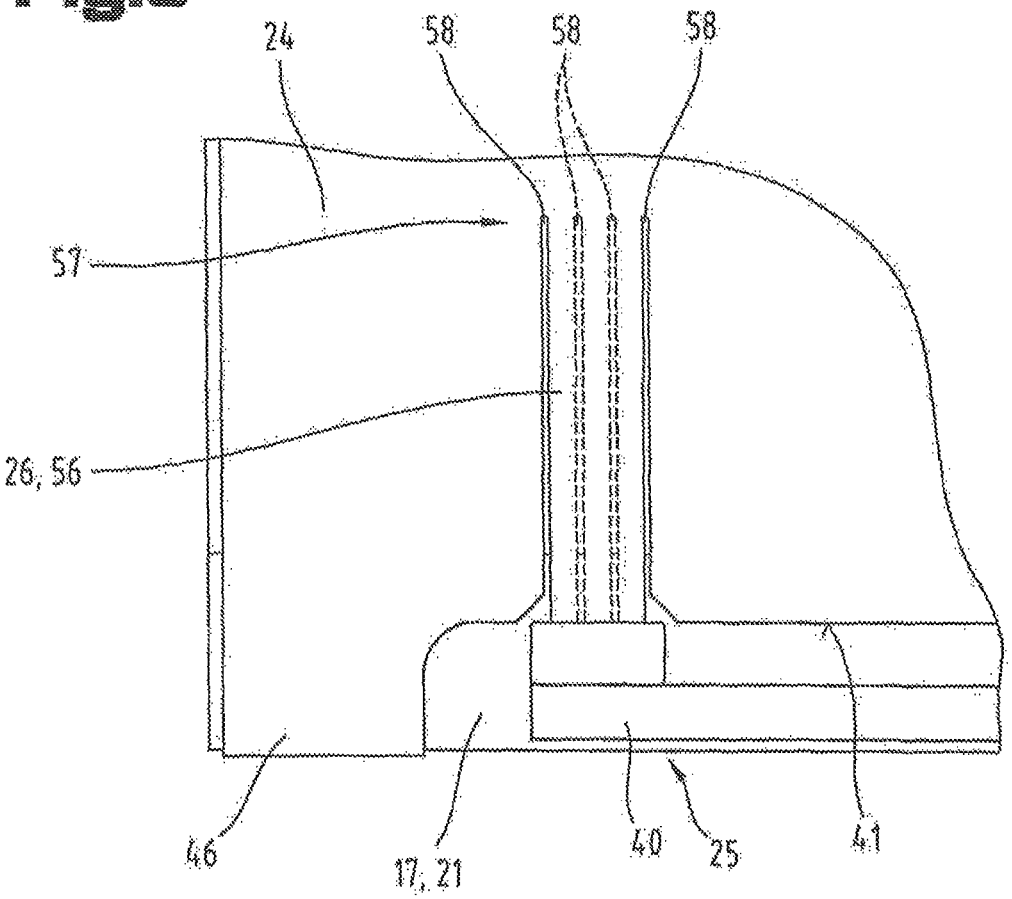
FIG. 8 illustrates another possible embodiment of the connection of a beam element and a support beam element.

FIG. 8 illustrates another possible embodiment of the connection between the beam element 17 and support beam element 24, and the connecting point 25 in this instance is also positioned on the bottom cross-connector 40 of the U-shaped beam element 17. The connecting element 26 in this embodiment is a bending-resistant element 56, which is fixedly secured by its bottom end on the cross-connector 40 and the top end of which is fixedly connected to a fixing point 57 on the support beam element 24. The bending-resistant element 56 may be provided as a separate component which is secured to the connecting point 25 and to the fixing point 57 by its two ends but it would also be possible for the bending-resistant element 56 to be formed by the support beam element 24 itself, in which case vertical slots 58 are provided in the plate-shaped main body of the support beam element 24, thereby creating the bending-resistant element 56 between the parallel slots 58. The slots 58 may also extend in a direction other than the vertical direction.

In spite of the fixed connection at the connecting point 25 on the cross-connector 40 and on the fixing point 57, increased movement occurs between the beam element 17 and the support beam element 24 due to the length of the bending-resistant element 56, which is useful when actively creating the camber 12. The ability to allow relative movement can be enhanced by providing additional slots 58, for example, as indicated by broken lines in FIG. 8.

The embodiments illustrated as examples represent possible variants of the press table or press beam, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

The objective underlying the independent inventive solutions may be found in the description.

Above all, the individual embodiments of the subject matter illustrated in FIGS. 1, 2; 3; 4; 5; 6; 7; 8 constitute independent solutions proposed by the invention in their own right. The objectives and associated solutions proposed by the invention may be found in the detailed descriptions of these drawings.

| List of reference numbers | |
|---|---|
| 1 | Press brake |
| 2 | Workpiece |
| 3 | Press table |
| 4 | Press beam |
| 5 | Guide arrangement |
| 6 | Drive means |
| 7 | Flexion |
| 8 | Standing surface |
| 9 | Force |
| 10 | Driving force |
| 11 | Forming force |
| 12 | Camber |
| 13 | Bottom face |
| 14 | Top face |
| 15 | Bending die |
| 16 | Bending punch |
| 17 | Beam element |
| 18 | Support surface |
| 19 | Bending tool |
| 20 | Clamping device |
| 21 | Arm |
| 22 | Working plane |
| 23 | Base |
| 24 | Support beam element |
| 25 | Connecting point |
| 26 | Connecting element |
| 27 | Bolt |
| 28 | Pressure surface |
| 29 | Pressure surface |
| 30 | Actuator |
| 31 | Pressing direction |
| 32 | Adjusting force |
| 33 | Hose arrangement |
| 34 | Hydraulic fluid |
| 35 | Hose portion |
| 36 | Recess |
| 37 | Mid-plane |
| 38 | Bending length |
| 39 | Length |
| 40 | Cross-connector |
| 41 | Recess |
| 42 | Pressurized fluid supply unit |
| 43 | Valve |
| 44 | Pulse-width modulator |
| 45 | Height |
| 46 | Foot |
| 47 | Pressure segment |
| 48 | Bottom face |
| 49 | Top face |
| 50 | Bearing recess |
| 51 | Slide bearing |
| 52 | Pivot bearing |
| 53 | Sliding piece |
| 54 | Slide surface |
| 55 | Guide recess |
| 56 | Bending-resistant element |
| 57 | Fixing point |
| 58 | Slot |

The invention claimed is:

1. A press table or a press beam for a press brake, the press table or the press beam comprising a beam element with an elongate support surface, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the elongate support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, and wherein a pivot bearing is provided on the connecting points.

2. The press table or the press beam according to claim 1, wherein the beam element and the support beam element are of a plate-shaped design, mutually overlap in at least certain portions, and extend substantially parallel with a working plane or a press plane of the press table or of the press beam.

3. The press table or the press beam according to claim 2, wherein the beam element or the support beam element forms a U-shaped cross-section in at least some portions with a base and adjoining arms, and wherein the beam element extends around the support beam element or the support beam element extends around the beam element at least partially on either side via the adjoining arms.

4. The press table or the press beam according to claim 1, wherein the hose arrangement has a working length between the pressure surfaces, the working length approximately corresponding to a distance between two mutually spaced connecting points on the beam element.

5. The press table or the press beam according to claim 1, wherein the hose arrangement lies closer to the elongate support surface than to the mutually spaced connecting points.

6. The press table or the press beam according to claim 1, wherein the mutually-spaced connecting points are disposed, relative to a height of the beam element, in a first half of the beam element, the first half being adjacent to the elongate support surface in a working direction.

7. The press table or the press beam according to claim 1, wherein the connecting elements are bolts, wherein the mutually spaced connecting points or the bolts are disposed, relative to a height of the beam element, in a first half of the beam element, the first half being spaced at a distance apart from the elongate support surface in the working direction.

8. The press table or the press beam according to claim 1, wherein the beam element is in contact with the support beam element in a region of the pressure surfaces when the hose arrangement is without pressure.

9. The press table or the press beam according to claim 1, wherein the hose arrangement comprises a hose portion with a strengthening material made from a synthetic fiber braid.

10. The press table or the press beam according to claim 1, wherein a pressurized fluid supply unit connected to the hose arrangement has at least one substantially leakage-free valve.

11. A press table or a press beam for a press brake, the press table or the press beam comprising a beam element with an elongate support surface, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the elongate support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, and wherein a slide bearing is provided on the mutually spaced connecting points.

12. A press table or a press beam for a press brake, the press table or the press beam comprising a beam element with an elongate support surface, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the elongate support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, and wherein at least one bending-resistant element extends respectively from the mutually spaced connecting points on the beam element to a fixing point on the support beam element.

13. A press table or a press beam for a press brake, the press table or the press beam comprising a beam element with an elongate support surface for attaching a bending tool or a tool adapter, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the elongate support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, wherein the beam element or the support beam element forms a U-shaped cross-section in at least some portions with a base and adjoining arms, and wherein the adjoining arms are retained by at least one cross-connector at a fixed distance from one another after the hose arrangement as viewed from the elongate support surface.

14. A press table or a press beam for a press brake, the press table or the press beam comprising a beam element with an elongate support surface, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the elongate support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, and wherein the hose arrangement comprises at least two hose portions extending parallel with one another and hydraulically connected in parallel.

15. The press table or the press beam according to claim 14, wherein adjacent parallel hose portions are connected to one another to form a hose assembly.

16. The press table or the press beam according to claim 15, wherein the hose arrangement comprises two or more hose assemblies lying one above the other in the pressing direction.

17. A press table or a press beam for a press brake, the press table or the press beam comprising a beam element with an elongate support surface, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the elongate support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, and wherein the pressure surfaces have concave recesses for partially accommodating the hose arrangement.

18. A press table or a press beam for a press brake, the press table or the press beam comprising a beam element with an elongate support surface, the beam element having a length, having mutually spaced connecting points disposed symmetrically to a mid-plane of the press table or of the press beam, and having a pressure surface, a support beam element having a length and a pressure surface, the length of the support beam element being approximately equal to the length of the beam element, the pressure surface facing the pressure surface of the beam element, connecting elements connecting the mutually spaced connecting points on the beam element to the support beam element, and at least one actuator acting between the pressure surfaces on the beam element and on the support beam element, the at least one actuator being able to exert an adjusting force that runs approximately in a pressing direction of the press brake, the adjusting force actively adjusting the support surface of the beam element between a planar profile and a convex profile, wherein the at least one actuator comprises a hose arrangement arranged between the pressure surfaces of the beam element and of the support beam element, rests against the pressure surfaces of the beam element and of the support beam element, is fillable with hydraulic fluid, and extends substantially in a longitudinal direction of the beam element, and wherein a pressurized fluid supply unit connected to the hose arrangement has at least one substantially leakage-free valve comprising an electromagnetic operating unit.

19. The press table or the press beam according to claim 18, wherein the valve is activated by a pulse-width modulator.

* * * * *